US007104242B2

(12) United States Patent
Nishi et al.

(10) Patent No.: US 7,104,242 B2
(45) Date of Patent: Sep. 12, 2006

(54) INTERNAL COMBUSTION ENGINE INCLUDING SPLASH-RESISTANT OIL STORAGE STRUCTURE

(75) Inventors: Toru Nishi, Saitama (JP); Masaoka Takahashi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/959,588

(22) Filed: Oct. 6, 2004

(65) Prior Publication Data

US 2005/0120994 A1 Jun. 9, 2005

(30) Foreign Application Priority Data

Oct. 8, 2003 (JP) ..... 2003-349969

(51) Int. Cl.
*F01M 1/02* (2006.01)

(52) U.S. Cl. ..... 123/196 R

(58) Field of Classification Search ..... 123/196 R, 123/195 C; 184/106, 6.5
See application file for complete search history.

(56) References Cited

U.S. PATENT DOCUMENTS 4,134,380 A * 1/1979 Niwa et al. ..... 123/142.5 R
6,244,237 B1 * 6/2001 Sayama et al. ..... 123/192.2

FOREIGN PATENT DOCUMENTS

JP 11141400 A 5/1999

* cited by examiner

*Primary Examiner*—Stephen K. Cronin
*Assistant Examiner*—Hyder Ali
(74) *Attorney, Agent, or Firm*—Carrier Blackman & Associates, P.C.; William D. Blackman; Joseph P. Carrier

(57) ABSTRACT

An oil storage structure for an internal combustion engine is configured so that an oil pickup port remains immersed when an oil surface fluctuates, both in the fore-and-aft direction due to acceleration and deceleration of a vehicle, and also in the lateral direction, due to sudden turning of the vehicle. The oil storage structure includes an oil storage chamber provided at the bottom of the internal combustion engine, and an oil supply pipe for drawing in oil from a pickup port in the oil storage chamber. The oil storage chamber includes a first subchamber having an opening on top thereof for receiving the oil supply pipe, and a second oil subchamber provided adjacent to the first oil subchamber, and substantially sealed in relation thereto. An upper wall of the second oil subchamber is disposed at a level below a full oil surface level of the first oil subchamber.

19 Claims, 5 Drawing Sheets

INTERNAL COMBUSTION ENGINE INCLUDING SPLASH-RESISTANT OIL STORAGE STRUCTURE

CROSS-REFERENCE TO RELATED APPLICATIONS

The present invention claims priority under 35 USC 119 based on Japanese patent application No. 2003-349969, filed Oct. 8, 2003.

BACKGROUND OF THE INVENTION

1. Technical Field of the Invention

The present invention relates to internal combustion engines, for powering vehicles such as cars or motorcycles. More particularly, the present invention relates to an internal combustion engine incorporating a splash-resistant oil storage structure.

2. Background Art

Internal combustion engines are in wide use for powering many types of vehicles. One example of a known oil storage structure in the lower end of a crankcase, for example, includes an oil storage chamber, an oil supply pipe which extends into the oil storage chamber from above, and a pickup port provided at the lower end of the oil supply pipe. The pickup port opens near the bottom surface of the oil storage chamber (bottom surface of the crankcase). The upper end of the oil supply pipe is connected to an oil pump via an oil channel formed on a side wall of the crankcase. Oil from the oil storage chamber is drawn into the pickup port by operation of the oil pump, and supplied to respective lubricating points and cooling points of an engine.

In the oil storage structure as described above, the surface of the oil stored in the oil storage chamber tends to flow in a direction opposite vehicle movement and deviates rearwardly or forwardly in response to normal acceleration or deceleration. In addition, when the vehicle is suddenly accelerated or decelerated, the amount of deviation of the surface of the oil stored in the oil storage chamber increases, and hence the pickup port may become exposed to air and uncovered with oil.

Therefore, as disclosed in Japanese published patent document JP-A-1-141400 for example, an oil storage structure for an engine has been proposed, in which front and rear secondary oil chambers are formed respectively on the front side and the rear side of the engine. These secondary oil chambers are partitioned from the oil storage chamber by partitioning walls, and covered on top by a ceiling wall. In the oil storage structure disclosed in the reference, oil flow orifices are formed at the lower ends of the respective partitioning walls, and the respective ceiling walls are formed with air holes therein. In this arrangement, fluctuation of the oil surface in the fore-and-aft direction in case of sudden acceleration and deceleration of the vehicle can be restrained.

However, in the oil storage structure as described above, since the secondary oil chambers defined by the partitioning walls are provided only at the front and rear of the engine, fluctuation of the oil surface in the lateral direction in case of sudden turning of the vehicle cannot be restrained. Therefore, it is still possible for the oil pickup port to be temporarily uncovered during a sudden and sharp turn of the vehicle.

SUMMARY OF THE INVENTION

Accordingly, it is an object of the present invention to provide an oil storage structure for an internal combustion engine in which an oil pickup port can be kept immersed, not only when an oil surface fluctuates in the fore-and-aft direction due to sudden acceleration and deceleration of a vehicle, but also when the oil surface fluctuates in a lateral direction, due to sudden turning of the vehicle.

In order to achieve the object described above, an oil storage structure for an internal combustion engine according to a first embodiment of the present invention includes an oil storage chamber provided at a lower portion of the internal combustion engine, and an oil supply pipe having a pickup port disposed proximate the bottom of the oil storage chamber and provided for drawing in oil stored in the oil storage chamber through the pickup port using an oil pump. The oil storage structure according to the first embodiment is characterized in that the oil storage chamber includes a first subchamber having an opening on top thereof, for receiving an oil supply pipe, and a second subchamber disposed adjacent to the first subchamber so as to communicate with the first subchamber at the side thereof. The oil storage structure according to the first embodiment is further characterized in that a ceiling wall of the second subchamber is located below a normal full oil level of the first subchamber.

In the embodiment of the invention described above, preferably, a crankshaft is rotatably retained in the internal combustion engine, and the first subchamber and the second subchamber are disposed side-by-side, with the dividing line therebetween being substantially parallel to a rotational axis of the crankshaft.

In addition, in the above-described embodiment, a crank chamber is disposed in the internal combustion engine for storing the crankshaft, and a communicating portion is provided between the crank chamber and the second subchamber, for allowing fluid communication therebetween.

Optionally, the crank chamber and the second subchamber may have a reed valve provided at the communicating portion, for allowing oil to flow in only one direction from the crank chamber to the second subchamber.

In the above-described embodiment of the invention, a ceiling wall of the second subchamber may be formed by a wall of the crank chamber.

Furthermore, in the above-described embodiment of the invention, the internal combustion engine may be a four-cycle internal combustion engine having a cam chain for transmitting a rotational force of the crankshaft to a camshaft, and a cam chain chamber for accommodating the cam chain, and the cam chain chamber may be provided above the opening of the first subchamber.

According to the described embodiment of the present invention, since the ceiling wall of the second subchamber, in the substantially sealed state, is disposed below the normal full level in the first subchamber, only the oil surface of the first subchamber in which the pickup port of the oil supply pipe is disposed can be disposed at the higher level. As a result, the pickup port of the oil supply pipe can remain immersed, not only when the oil surface fluctuates in the fore-and-aft direction in case of sudden acceleration and deceleration of the vehicle, but also when the oil surface fluctuates in a lateral direction in case of sudden turning of the vehicle.

By disposing the first subchamber and the second subchamber side-by-side with the dividing line therebetween being parallel to the rotational axis of the crankshaft, the position of the pickup port of the oil supply pipe can be shifted toward one side, and hence piping of the oil supply pipe can be facilitated.

In addition, by providing the communicating portion for communicating between the crank chamber and the second subchamber, and by providing a reed valve for allowing oil to flow in only one direction from the crank chamber to the second subchamber via the communicating portion, oil stored in the crank chamber can be introduced to the second subchamber utilizing variation in air pressure in the crank chamber, without being reversed.

By forming the ceiling wall of the second subchamber by the wall of the crank chamber, the second subchamber can be formed compactly without using an additional sealing member.

In addition, by providing the cam chain chamber above the opening of the first subchamber, oil reached to the respective points of the internal combustion engine can be returned efficiently without a necessity to provide a separate oil return channel.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

It should be understood that only structures considered necessary for clarifying the present invention are described herein. Other conventional structures, and those of ancillary and auxiliary components of the system, are assumed to be known and understood by those skilled in the art.

Figure 1:
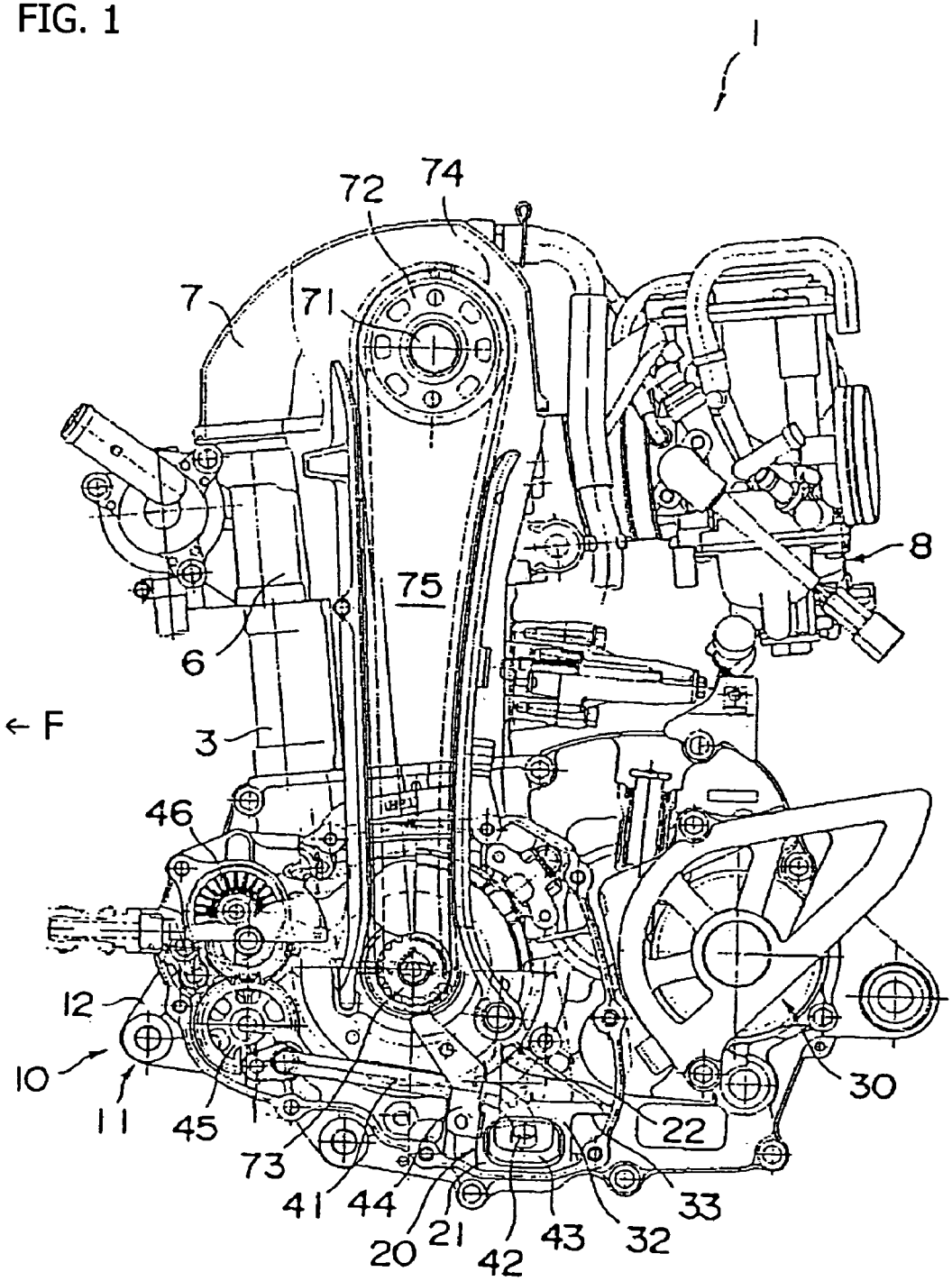
FIG. 1 is a left side plan view (partly in cross-section with a left cover removed) of a four-cycle engine for a saddle-type vehicle, as an example of an internal combustion engine including an oil storage structure according to an embodiment of the present invention.
Figure 2:
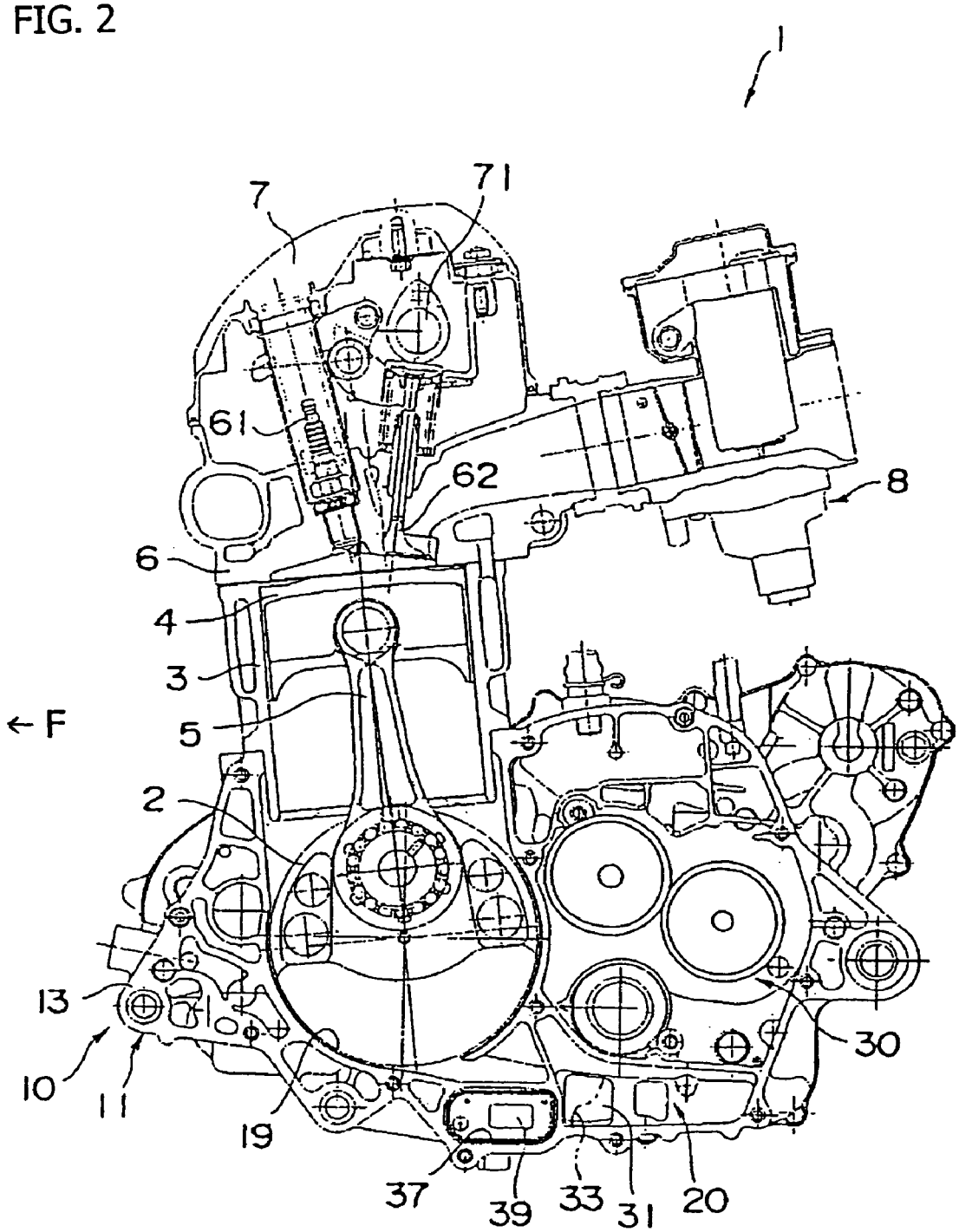
FIG. 2 is a left side cross-sectional view of the engine of FIG. 1.

Hereinafter, referring to the drawings, a selected illustrative embodiment of the present invention will be described. Referring initially to FIGS. 1 and 2, a four-cycle engine for a saddle-type vehicle is shown generally at 1, as an example of an internal combustion engine provided with an illustrative embodiment of an oil storage structure according to the present invention.

The engine 1 is a transverse engine, with a crankcase 11 housing a crankshaft 2, such that the crankshaft 2 is adapted to be oriented extending laterally of a vehicle (not shown), when installed therein. The engine 1 is adapted to be is mounted to a vehicle so that the left side in each of FIGS. 1 and 2 is directed toward the front of the vehicle, when viewed in the direction of travel of the vehicle, as indicated by the arrow F in FIGS. 1 and 2.

Figure 3:
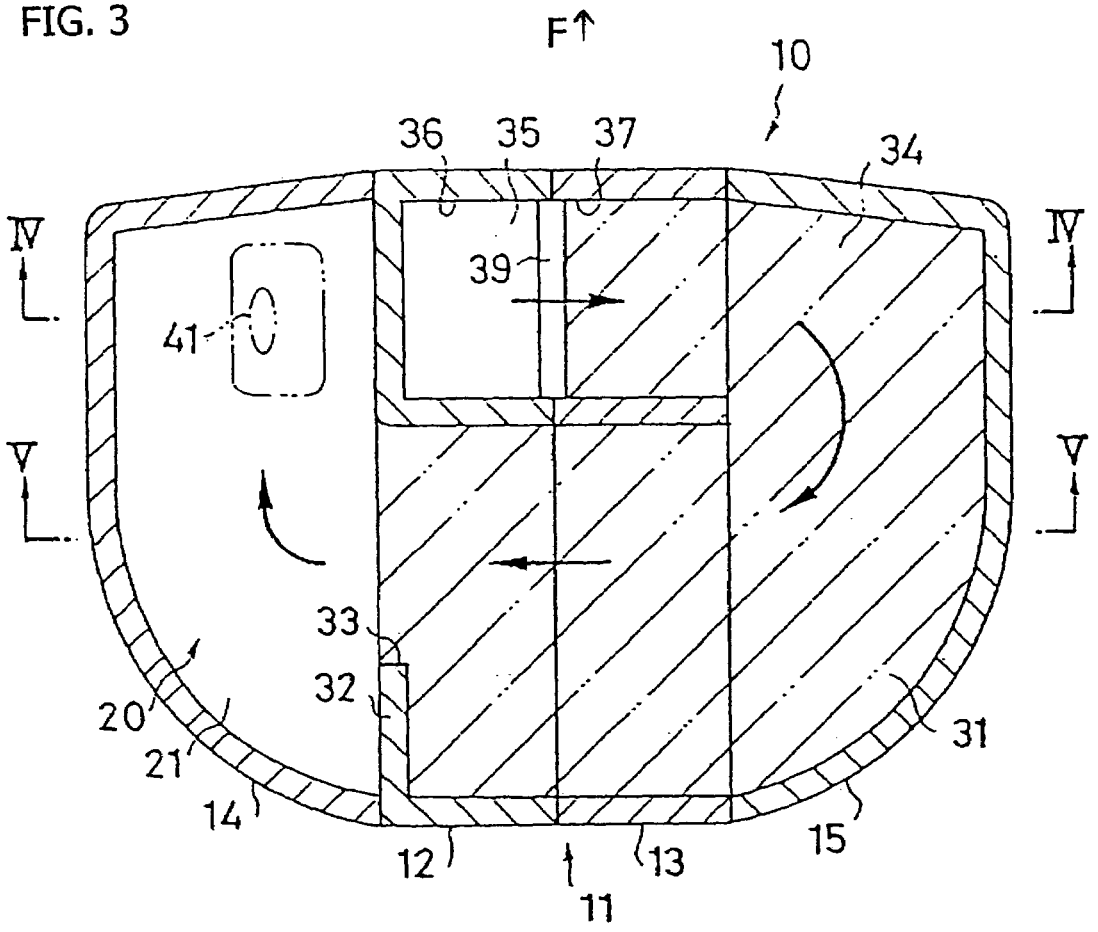
FIG. 3 is a top plan view, partially in cross-section, of a bottom portion of a powertrain unit case of the engine of FIG. 1.
Figure 4:
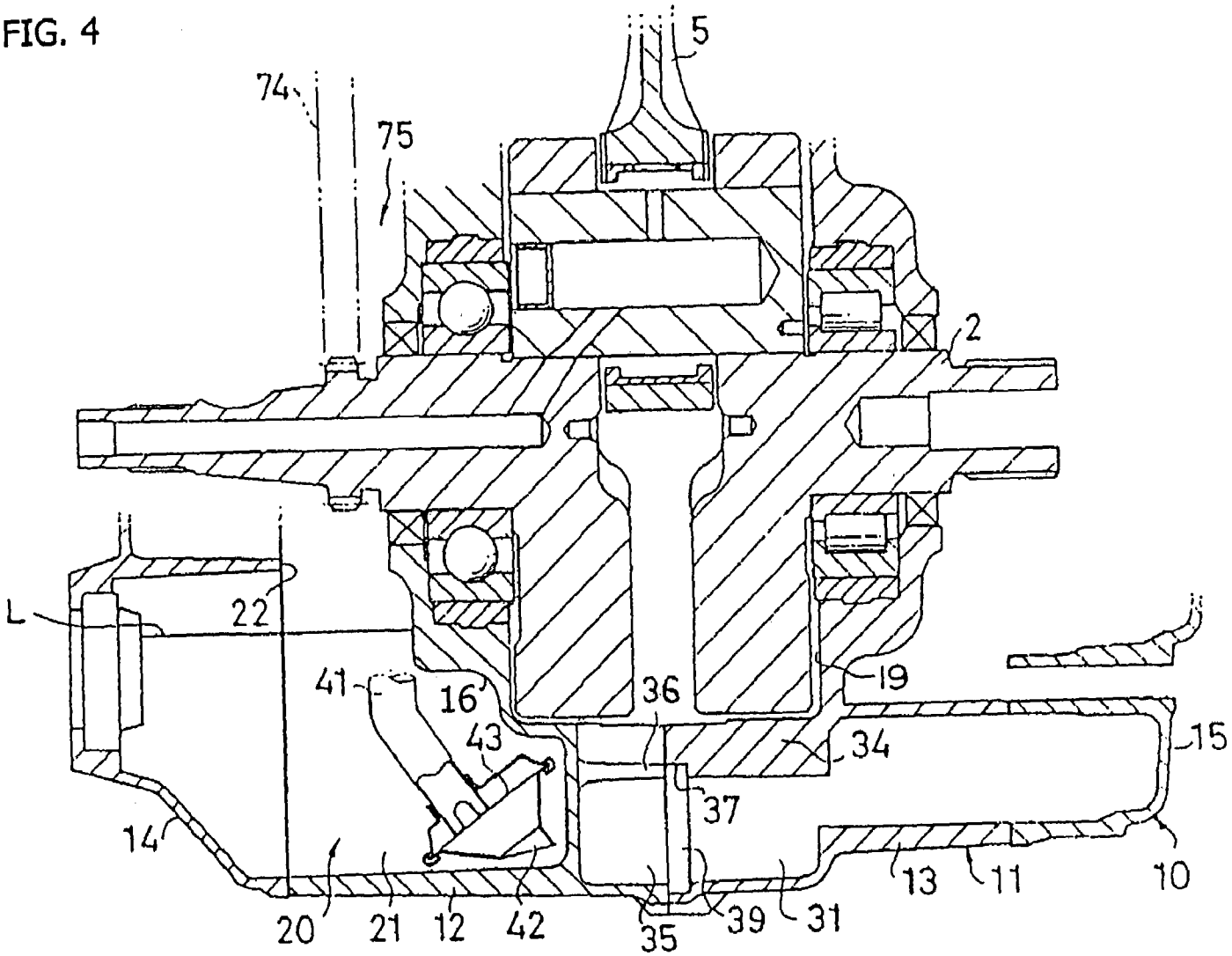
FIG. 4 is a cross-sectional view of the engine of FIG. 1, taken along an arrow IV—IV in FIG. 3.
Figure 5:
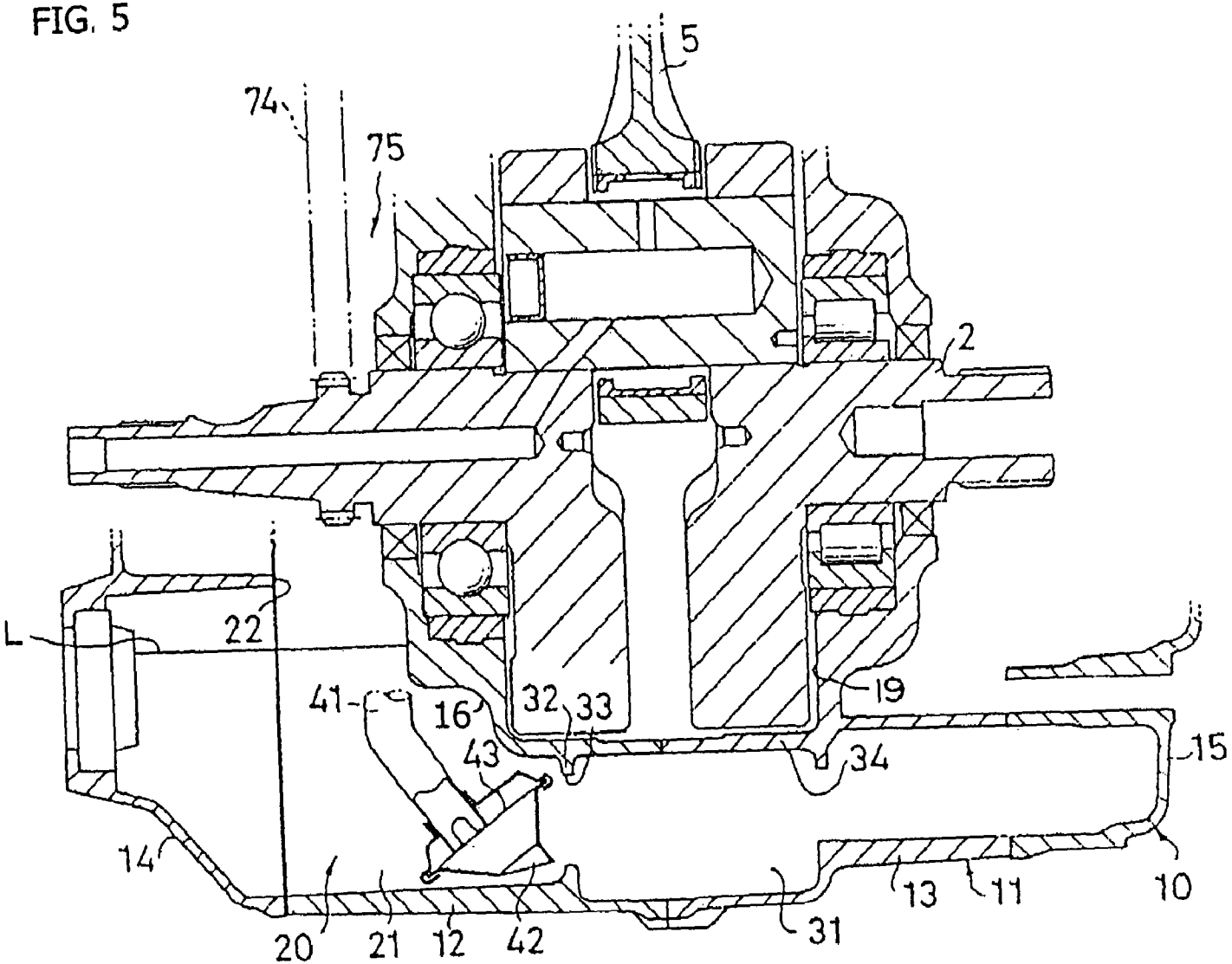
FIG. 5 is a cross-sectional view of the engine of FIG. 1, taken along an arrow V-V in FIG. 3.

The crankcase 11 of the engine 1 has a two-piece structure, including a left case 12 and a right case 13 (see also FIGS. 3–5). A crank chamber 19 (FIGS. 2, 4) is defined in the crankcase 11 for accommodating the crankshaft 2, so that the crankshaft 2 is rotatably stored and retained in the crank chamber 19.

As shown in FIG. 3 to FIG. 5, the left side of the left case 12 is covered by a left cover 14, and the right side of the right case 13 is covered by a right cover 15 and a clutch cover (not shown), whereby a powertrain unit case 10 is configured.

The left case 12 and the right case 13 of the crankcase 11, respectively, include side walls, which are formed with crankshaft supporting holes, supporting holes for various other rotary members, and recesses (not shown) formed therein.

The engine 1 also includes a cylinder block 3, which is connected to the front upper end of the crankcase 11, as shown in FIG. 2. A piston 4 is stored in the cylinder bock 3 so as to be capable of slidable reciprocating movement therein, and the piston 4 is connected to the crankshaft 2 via a connecting rod 5. A cylinder head 6 and a cylinder head cover 7 are joined to the upper end of the cylinder block 3, and a carburetor 8 is connected to the cylinder head 6. A fuel injector and associated ducting (not shown) could be used in place of the carburetor 8.

A spark plug 61 and a valve 62 are disposed in the cylinder head 6, and a camshaft 71 for activating the valve 62 is rotatably retained below the cylinder head cover 7. As shown in FIG. 1, a camshaft sprocket 72 is provided at the left end of the camshaft 71, and a crankshaft sprocket 73 is provided on the left side of the crankshaft 2. A cam chain 74 is wound around the camshaft sprocket 72 and the crankshaft sprocket 73, so that a rotational force of the crankshaft 2 is transmitted to the camshaft 71 via the cam chain 74. The cam chain 74 is stored in a cam chain chamber 75 formed across the left cover 14 and the cylinder head cover 7.

As shown in FIG. 2, a transmission 30 (speed change gear) is disposed in the powertrain unit case 10, and the rotational force of the crankshaft 2 is transmitted to a drive wheel (not shown), via the transmission 30.

As shown in FIG. 3 to FIG. 5, an oil storage chamber 20 is disposed at the lower portion of the powertrain unit case 10, and a predetermined amount of lubricating and cooling oil is stored therein. The oil storage chamber 20 includes a first subchamber 21, provided on the lower left side of the powertrain unit case 10, and a second subchamber 31 provided on the lower right side of the powertrain unit case 10, abutting against the first subchamber 21.

The first subchamber 21 is formed so as to have an opening 22 (see FIG. 1 as well) at the top thereof, and at the lower left side of the powertrain unit case 10. In other words, the opening 22 of the first subchamber is located at the upper portion of a clearance between the lower left side of the left case 12 and the lower right side of the left cover 14.

The crankcase 11 includes an internal partition wall 16 separating the crank chamber 19 from the first subchamber 21 of the oil storage chamber 20, as shown. The partition wall 16 helps to define the crank chamber 19, and serves as a barrier to prevent the crankshaft from splashing into the oil.

As shown in FIGS. 4 and 5, the crankcase 11 is configured, and the normal full level of an oil surface L (oil level) in the first subchamber 21 is selected so as to prevent oil from being directly contacted by the moving crankshaft 2 or the like, and from thereby being subjected to a stirring resistance.

As shown in FIG. 1, an oil supply pipe 41 is fixedly mounted to the left side of the left case 12 using a mounting plate 44 and a fixing bolt (not shown), and the oil supply pipe 41 is positioned in the first subchamber 21. A pickup port 42 is formed at the lower end of the oil supply pipe 41, and opens at the position in the vicinity of the bottom of the first subchamber 21. A strainer 43 (filter) is disposed at the pickup port 42.

The upper end of the oil supply pipe 41 is connected to an oil pump 45 via an oil channel (not shown) formed on the side wall of the crankcase 11, and when the engine 1 is running, oil from the oil storage chamber 20 (first subchamber 21) is drawn in through the pickup port 42, using the oil pump 45.

The oil pump 45 is disposed on the left case 12, and is adapted to direct oil drawn from the pickup port 42 of the oil supply pipe 41 to pass through an oil filter 46 provided on the left case 12. After the oil passes through the oil filter 46, it is then supplied to the respective lubricating points and cooling points of the engine 1, such as the crankshaft 2 and the piston 4.

As shown in FIG. 1 and FIG. 5, the cam chain chamber 75 is positioned above the opening 22 of the first subchamber 21. Accordingly, oil leaving the respective lubricating and cooling points of the engine 1 can be efficiently returned to the oil storage chamber 20 by gravity feed, without requiring a separate oil return channel.

The second subchamber 31 is formed so as to be substantially sealed on five sides thereof, by being surrounded by the respective walls formed on the left case 12, the right case 13, and the right cover 15 at the lower right side of the powertrain unit case 10, as shown in FIG. 3 and FIG. 5.

A partitioning baffle wall 32 is provided between the first subchamber 21 and the second subchamber 31, formed on the side wall of the left case 12, so that the first subchamber 21 and the second subchamber 31 communicate with each other via a communicating port 33 provided at the rear of the partitioning wall 32 (in other words, the first subchamber 21 and the second subchamber 31 communicate with each other on the side of the first subchamber 21).

Then, a ceiling wall 34 of the second subchamber 31 is provided at a position below the oil surface L in the first subchamber 21. Accordingly, since only the oil surface in the first subchamber 21, in which the pickup port 42 of the oil supply pipe 41 is disposed, can be positioned at the higher level, the pickup port 42 of the oil supply pipe 41 can be kept constantly immersed in the oil, not only when the oil surface fluctuates in the fore-and-aft direction in case of sudden acceleration or deceleration of the vehicle, but also when the oil surface fluctuates in the lateral direction in case of sudden turning of the vehicle.

The first subchamber 21 and the second subchamber 31 are disposed side-by-side in parallel with a rotational axis of the crankshaft 2. Accordingly, the position of the pickup port 42 of the oil supply pipe 41 can be shifted leftward (toward one side) of the powertrain unit case 10, whereby piping of the oil supply pipe 41 can be facilitated.

On the other hand, the crank chamber 19 is disposed above the second subchamber 31, and the ceiling wall 34 of the second subchamber 31 is formed by the wall of the crank chamber 19. Accordingly, the second subchamber 31 can be formed compactly, without using an additional sealing member.

As shown in FIGS. 3 and 4, a communicating portion 35 is provided as a passage extending between the second subchamber 31 and the crank chamber 19, for allowing fluid communication therebetween. The communicating portion 35 is a chamber positioned on the left front portion (forwardly of the communicating port 33) of the second subchamber 31. An opening 36 is provided on the upper side of the communicating portion 35 in communication with the crank chamber 19, and an opening 37 is provided on the right side of the communicating portion 35 on the side of the oil storage chamber in communication with the second subchamber 31, so that the crank chamber 19 and the second subchamber 31 communicate wit each other via the communicating portion 35.

A reed valve 39 (see also FIG. 2) to allow oil to flow in one direction from the crank chamber 19 to the second subchamber 31 is disposed at the opening 37 of the communicating portion 35 on the side of the oil storage chamber. Accordingly, oil can be introduced into the second subchamber 31 utilizing variation in air pressure in the crank chamber 19 without reversing oil stored in the crank chamber 19.

Although not illustrated in detail, a mission oil pan (not shown) is provided independently from the oil storage chamber 20 within the right cover 15 of the powertrain unit case 10, so that oil is splashed and supplied to the respective lubricating points and cooling points of the transmission 30.

In the four-cycle engine 1 for a saddle-type vehicle configured as described above, when the engine 1 is started, the oil pump 45 is activated and oil in the first oil subchamber 21 is sucked from the pickup port 42 of the oil supply pipe 41. The oil sucked by the oil pump 45 passes through the oil channel (not shown) formed on the side wall of the crankcase 11 and the oil filter 46, and then is supplied to the respective lubricating points and the cooling points of the engine 1. The oil supplied to the respective lubricating points and the cooling points of the engine 1 lubricates and cools the respective points of the engine and then is returned to the oil storage chamber 20.

At this time, for example, the oil supplied to the crankshaft 2 lubricates the crankshaft 2, then flows down to the bottom of the crank chamber 19, and then flows down from the opening 36 on the side of the crank chamber to the communicating portion 35.

As shown in FIG. 3 to FIG. 5, the oil flowing down to the communicating portion 35 passes through the reed valve 39 utilizing variation in air pressure in the crank chamber 19, and is introduced into the second subchamber 31. When the oil flows into the second subchamber 31, since the second subchamber 31 is in the substantially sealed state, and the reed valve 39 is disposed so that oil flows only in one direction from the crank chamber 19 to the second subchamber 31, the oil in the second subchamber 31 passes through the communicating port 33 and flows into the first subchamber 21.

Since the oil surface L of oil in the first subchamber 21 is located at the position higher than the second subchamber 31, and further, the first subchamber 21 is located on the left side of the powertrain unit case 10 so that the cross-sectional area is small, the pickup port 42 of the oil supply pipe 41 is prevented from being exposed not only when fluctuation of the oil surface in the fore-and-aft direction is increased in case of sudden acceleration or deceleration of the vehicle, but also when fluctuation of the oil surface in the lateral direction is increased in case of sudden turning of the vehicle.

According to the oil storage structure of the engine 1 configured as described above, since the ceiling wall 34 of the second subchamber 31 in the sealed state is located below the normal full level L of the first subchamber 21, only the oil surface in the first subchamber 21 in which the pickup port 42 of the oil supply pipe 41 is disposed can be positioned at the higher level. As a result, the pickup port 42 of the oil supply pipe 41 can remain immersed, not only when fluctuation of the oil surface in the fore-and-aft direction is increased in case of sudden acceleration or deceleration of the vehicle, but also when fluctuation of the oil surface in the lateral direction is increased in case of sudden turning of the vehicle.

By disposing the first subchamber 21 and the second subchamber 31 side-by-side in parallel with the rotational axis of the crankshaft 2, the position of the pickup port 42 of the oil supply pipe 41 can be shifted toward one side, and hence piping of the oil supply pipe 41 can be facilitated.

In addition, since the communicating portion 35 for communicating the crank chamber 19 and the second subchamber 31 is provided and the reed valve 39 for allowing oil to flow in one direction from the crank chamber 19 to the second subchamber 31 at the communicating portion 35, the oil can be introduced into the second subchamber 31 utilizing variation in air pressure in the crank chamber 19 without reversing oil stored in the crank chamber 19.

In addition, the ceiling wall 34 of the second subchamber 31 can be formed by the wall of the crank chamber 19, and hence the second subchamber 31 can be formed compactly without using an additional sealing member.

Furthermore, by providing the cam chain chamber 75 above the opening 22 of the first subchamber 21, the oil reached to the respective points of the engine 1 can be efficiently returned without forming a separate oil return channel.

In the above-described embodiment, the four-cycle engine 1 for a saddle-type vehicle is employed as the internal combustion engine provided with the oil storage structure according to the present invention. However, it is not limited thereto, and the present invention can be applied any type of internal combustion engine, as long as it is an internal combustion engine including an oil storage chamber provided at the lower portion thereof, and an oil supply pipe having the pickup port disposed near the bottom of the oil storage chamber, for drawing in oil stored in the oil storage chamber using an oil pump.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

We claim:

1. An internal combustion engine, comprising:

a crankcase;

an oil pump;

an oil storage chamber provided in the crankcase and disposed at a lower portion of the internal combustion engine; and an oil supply pipe having a pickup port disposed proximate the bottom of the oil storage chamber for drawing in oil stored in the oil storage chamber using the oil pump;

wherein the oil storage chamber comprises a first subchamber having an opening on top thereof for receiving the oil supply pipe, and a second subchamber disposed adjacent the first subchamber so as to communicate therewith at the side thereof;

a partitioning wall is provided between the first subchamber and the second subchamber, said partitioning wall comprising a portion extending substantially vertically and having an open and unobstructed communicating port formed in a rear portion thereof for establishing communication therebetween the first subchamber and the second subchamber; and the second subchamber comprises a ceiling wall located below a full oil level of the first subchamber.

2. An internal combustion engine, comprising:

a crankcase;

a crankshaft rotatably retained in the crankcase;

an oil pump;

an oil storage chamber provided in the crankcase and disposed at a lower portion of the internal combustion engine; and an oil supply pipe having a pickup port disposed proximate the bottom of the oil storage chamber for drawing in oil stored in the oil storage chamber using the oil pump;

wherein the oil storage chamber comprises a first subchamber having an opening on top thereof for receiving the oil supply pipe, and a second subchamber disposed adjacent the first subchamber so as to communicate therewith at the side thereof;

wherein the second subchamber comprises a ceiling wall located below a full oil level of the first subchamber;

wherein the crankcase comprises a crank chamber for storing the crankshaft; and a communicating portion is provided between the crank chamber and the second subchamber for permitting fluid communication therebetween; and wherein a check valve is provided at the communicating portion for allowing oil to flow in one direction therethrough from the crank chamber to the second subchamber.

3. An internal combustion engine according to claim 2, wherein the first and second subchambers are disposed side-by-side with a dividing line between the first and second subchambers being parallel to a rotational axis of the crankshaft.

4. An internal combustion engine according to claim 2, wherein a wall of the crank chamber forms the ceiling wall of the second subchamber.

5. An internal combustion engine according to claim 2, further characterized in that the internal combustion engine comprises a cam chain for transmitting a rotational force of the crankshaft to a camshaft, and a cam chain chamber for accommodating the cam chain, and the cam chain chamber is provided above the opening of the first subchamber.

6. The internal combustion engine of claim 2, wherein the check valve is a reed valve.

7. The internal combustion engine of claim 2, wherein an internal partition wall separates the crank chamber from the first subchamber of the oil storage chamber.

8. An internal combustion engine, comprising:

a crankcase having a crank chamber formed therein for housing a crankshaft, said crankcase having an oil storage chamber defined therein at a lower portion of said engine, and an internal partition wall substantially separating the crank chamber from the oil storage chamber;

a crankshaft rotatably disposed in said crank chamber;

an oil pump for drawing oil out of the crankcase; and an oil supply pipe having a pickup port disposed proximate the bottom of the oil storage chamber for drawing in oil stored in the oil storage chamber using the oil pump;

wherein the oil storage chamber comprises:

a first subchamber having an opening formed therein for receiving the oil supply pipe, said first subchamber having a full oil level therein; and a second subchamber disposed in abutting relation adjacent the first subchamber so as to communicate therewith at the side thereof; and wherein the crankcase comprises a ceiling wall located above the second subchamber and below the full oil level of the first subchamber; and wherein a communicating portion is provided between the crank chamber and the second subchamber for permitting fluid communication therebetween.

9. An internal combustion engine according to claim 8, wherein the first and second subchambers are disposed side-by-side with a dividing line between the first and second subchambers being parallel to a rotational axis of the crankshaft.

10. An internal combustion engine according to claim 8, wherein a check valve is provided at the communicating portion for allowing oil to flow in one direction therethrough from the crank chamber to the second subchamber.

11. An internal combustion engine according to claim 8, wherein a wall of the crank chamber forms the ceiling wall of the second subchamber.

12. An internal combustion engine according to claim 8, further comprising a camshaft and a cam chain operatively connecting the camshaft to the crankshaft for transmitting a rotational force of the crankshaft to the camshaft, and a cam chain chamber for accommodating the cam chain; wherein the cam chain chamber is provided above the opening of the first subchamber.

13. The internal combustion engine of claim 10, wherein the check valve is a reed valve.

14. An internal combustion engine according to claim 8, wherein a reed valve is provided at the communicating portion for allowing oil to flow in one direction therethrough from the crank chamber to the second subchamber; and wherein a wall of the crank chamber forms the ceiling wall of the second subchamber.

15. An internal combustion engine according to claim 14, further comprising a camshaft and a cam chain operatively connecting the camshaft to the crankshaft for transmitting a rotational force of the crankshaft to the camshaft, and a cam chain chamber for accommodating the cam chain;

wherein the cam chain chamber is provided above the opening of the first subchamber.

16. An internal combustion engine, comprising:

an oil storage chamber having a first subchamber and a second subchamber disposed adjacent the first subchamber so as to communicate therewith at the side thereof;

an oil pump for supplying oil to the engine for lubrication thereof; and an oil supply pipe having a pickup port disposed proximate the bottom of the first subchamber for drawing in oil stored therein using the oil pump; wherein said oil storage chamber disposed at a lower portion of the engine;

the second subchamber comprises a ceiling wall located below a full oil level of the first subchamber; and a cross sectional area of the first subchamber along a horizontal plane is narrower than a cross sectional area of the second subchamber along a horizontal plane, whereby the pickup port remains immersed in oil during engine operation irrespective of oil surface fluctuation;

wherein the crankcase comprises a crank chamber for storing a crankshaft; and a communicating portion is provided between the crank chamber and the second subchamber for permitting fluid communication therebetween; and wherein a check valve is provided at the communicating portion for allowing oil to flow in one direction therethrough from the crank chamber to the second subchamber.

17. An internal combustion engine according to claim 16, wherein the check valve is a reed valve.

18. An internal combustion engine according to claim 16, further comprises a partitioning baffle wall provided between the first subchamber and the second subchamber, the baffle wall having a communicating port provided at the rear thereof for establishing communication between the first and second subchambers.

19. An internal combustion engine, comprising:

a crankcase having a crank chamber and a internal partition wall;

an oil pump;

an oil storage chamber provided in the crankcase and disposed at a lower portion of the internal combustion engine; and an oil supply pipe having a pickup port disposed proximate the bottom of the oil storage chamber for drawing in oil stored in the oil storage chamber using the oil pump;

wherein the oil storage chamber comprises a first subchamber having an opening on top thereof for receiving the oil supply pipe, and a second subchamber disposed adjacent the first subchamber so as to communicate therewith at the side thereof;

a partitioning wall is provided between the first subchamber and the second subchamber, said partitioning wall comprising a portion extending substantially vertically and having an open and unobstructed communicating port formed in a rear portion thereof for establishing communication therebetween the first subchamber and the second subchamber;

the second subchamber comprises a ceiling wall located below a full oil level of the first subchamber; and the internal partition wall separates the crank chamber from the first subchamber whereby forming a barrier to prevent the crankshaft from splashing oil contained in the first subchamber.

* * * * *